US009818388B2

(12) United States Patent
Bergman

(10) Patent No.: US 9,818,388 B2
(45) Date of Patent: Nov. 14, 2017

(54) METHOD FOR ADJUSTING THE COMPLEXITY OF A CHORD IN AN ELECTRONIC DEVICE

(71) Applicant: Berggram Development Oy, Helsinki (FI)

(72) Inventor: Jussi Bergman, Helsinki (FI)

(73) Assignee: Berggram Development Oy, Helsinki (FI)

( * ) Notice: Subject to any disclaimer, the term of this patent is extended or adjusted under 35 U.S.C. 154(b) by 0 days.

(21) Appl. No.: 15/121,079

(22) PCT Filed: Mar. 20, 2015

(86) PCT No.: PCT/FI2015/050191

§ 371 (c)(1),
(2) Date: Aug. 24, 2016

(87) PCT Pub. No.: WO2015/140412

PCT Pub. Date: Sep. 24, 2015

(65) Prior Publication Data

US 2016/0365077 A1 Dec. 15, 2016

(30) Foreign Application Priority Data

Mar. 21, 2014 (FI) ..... 20145268

(51) Int. Cl.
*G10H 1/38* (2006.01)

(52) U.S. Cl.
CPC ..... *G10H 1/38* (2013.01); *G10H 1/386* (2013.01); *G10H 2210/576* (2013.01)

(58) Field of Classification Search
CPC ..... G10H 1/38
USPC ..... 84/613
See application file for complete search history.

(56) References Cited

U.S. PATENT DOCUMENTS 5,639,977 A * 6/1997 Hesnan ..... G09B 15/003 84/477 R
6,657,115 B1 * 12/2003 Egorov ..... G10H 1/38 84/613
7,109,407 B2 * 9/2006 Hasegawa ..... G09B 15/04 84/613
7,288,711 B2 * 10/2007 Hasegawa ..... G09B 15/04 84/613
7,521,619 B2 * 4/2009 Salter ..... G09B 15/00 84/470 R
8,269,094 B2 * 9/2012 Buskies ..... G10H 1/0066 84/613

(Continued)

FOREIGN PATENT DOCUMENTS

EP 1416470 5/2004

*Primary Examiner* — David Warren
(74) *Attorney, Agent, or Firm* — BelayIP Oy

(57) ABSTRACT

Conventionally, an electronic musical user input, such as an electronic keyboard has pre-programmed pitches associated with each key. These pre-programmed pitches correspond to the pitches from their acoustic counterparts. While some methods do exist of remapping the keys in such a way that a user cannot make a so called 'bad' sound by playing a wrong 5 not, there is little freedom in the selection of the 'good' notes. Therefore, there is herein provided a method of adjusting the complexity of a chord which therein determines the actual set of pitches which can be assigned to a user input device in order to increase the flexibility of remapping systems.

19 Claims, 3 Drawing Sheets

(56) References Cited

U.S. PATENT DOCUMENTS

| | | | | |
|---|---|---|---|---|
| 8,759,658 | B2 * | 6/2014 | Buskies | G10H 1/0066 84/613 |
| 8,802,955 | B2 * | 8/2014 | Bergman | G10H 1/38 84/613 |
| 8,912,421 | B2 * | 12/2014 | Tanaka | G09B 15/002 84/478 |
| 9,418,645 | B2 * | 8/2016 | Little | G10H 1/0008 |
| 2003/0051595 | A1 * | 3/2003 | Hasegawa | G09B 15/04 84/637 |
| 2006/0027080 | A1 * | 2/2006 | Schultz | G10H 1/38 84/613 |
| 2006/0201311 | A1 * | 9/2006 | Hasegawa | G09B 15/04 84/613 |
| 2009/0151547 | A1 * | 6/2009 | Kobayashi | G10G 3/04 84/613 |
| 2011/0011246 | A1 * | 1/2011 | Buskies | G10H 1/0066 84/613 |
| 2013/0205977 | A1 * | 8/2013 | Buskies | G10H 1/0066 84/613 |
| 2014/0196592 | A1 * | 7/2014 | Bergman | G10H 1/38 84/613 |
| 2016/0140944 | A1 * | 5/2016 | Bergman | G06F 3/041 84/613 |
| 2016/0365077 | A1 * | 12/2016 | Bergman | G10H 1/38 |

* cited by examiner

| | |
|---|---|
| Major Chord Type | [ 1 , 9 , 4 , 11 , 2 , 7 , 10 , 3 , 8 , 5 , 12 , 6 ] |
| Notes | C C# D D# E F F# G G# A A# B |
| Key value | C = 10 |
| Created array | C major = 10 [ Major chord type] = [ 10 , 90 , 40 , 110 , 20 , 70 , 100 , 30 , 80 , 50 , 120 , 60 ] |
| Chord complexity value | = 60 |
| Determined pitches | = [ C , D , E , G , A , B ] |

FIG. 2

| | | |
|---|---|---|
| Current created array | $C_{major}$ | [10, 90, 40, 110, 20, 70, 100, 30, 80, 50, 120, 60]<br>C $C^{\#}$ D $D^{\#}$ E F $F^{\#}$ G $G^{\#}$ A $A^{\#}$ B |
| weight factor | | 1.0 |
| Previous created array | $D_{minor}$ | [28, 70, 126, 56, 154, 14, 112, 168, 84, 42, 140, 98]<br>D $D^{\#}$ E F $F^{\#}$ G $G^{\#}$ A $A^{\#}$ B C $C^{\#}$ |
| weight factor | | 0.5 |
| 2nd previous created array | $G^{\#}$ | [72, 162, 216, 18, 126, 36, 198, 90, 180, 108, 54, 144]<br>$G^{\#}$ A $A^{\#}$ B C $C^{\#}$ D $D^{\#}$ E F $F^{\#}$ G |
| weight factor | | 0.2 |
| Combined array | | [105.2, 146.2, 93.6, 163, 119, 119.6, 187.8, 65.8, 150.4, 166.4, 205.2, 84]<br>C $C^{\#}$ D $D^{\#}$ E F $F^{\#}$ G $G^{\#}$ A $A^{\#}$ B |

Chord complexity value = 110

Determined pitches = [ C , D , G , B ]

FIG. 3

METHOD FOR ADJUSTING THE COMPLEXITY OF A CHORD IN AN ELECTRONIC DEVICE

FIELD OF INVENTION

The present invention generally relates to the field of digital music. In particular the present invention relates to being able to dynamically adjust the complexity of a chord which a user can play discrete notes and/or pitches there from on an electronic device.

BACKGROUND OF INVENTION

Conventionally, an electronic musical instrument has pre-programmed pitches associated with each input. These pre-programmed pitches typically correspond to the pitches from the electronic instrument's acoustic counterpart. For example, someone familiar with paying an acoustic grand piano would be able to go to an electronic keyboard and immediately find the keys on the electronic keyboard which correspond to their counterparts on the acoustic grand piano and would be able to play a desired key by locating its position on the keyboard relative to the others.

A problem therefore exists that in order for someone to play an electronic keyboard as well as an acoustic piano they would need the same amount of training and practice as there is little if any difference between the playability of the two instruments. While some methods do exist of remapping the keys in such a way that a user can not make a so called 'bad' sound by playing a wrong not, there is little freedom in the selection of the 'good' notes. Players who would like to use current methods in reassigning the pitches of keys may want more or less freedom in the assignment of the pitches.

SUMMARY OF THE INVENTION

It is an object of the present invention to provide a method of adjusting the complexity of a chord.

It is a further object of the present invention to provide a computer readable medium having stored thereon a set of computer implementable instructions for carrying out the methods described herein.

Still yet, it is an object of the present invention to provide an electronic device having a processor, a user input, an audio output and a computer readable medium having stored thereon a set of computer implementable instructions for carrying out the methods described herein.

According to certain embodiments, the method includes the steps of receiving information about a chord including the key, chord type and desired chord complexity, creating an array by adding the key of the chord to progression data for the chord type, determining a set of pitches, based on the created array and desired chord complexity, from the key of the chord which correlate to the desired chord complexity, and assigning the set of pitches to a user input device which allows a user to play said set of pitches.

Examples of chord types are major chords, minor chords, augmented chords and diminished chords.

Each key may be represented by a unique numeric value. Each progression data set may be represented an array of numeric values corresponding to note positions within a scale. Creating an array for a chord may include multiplying the key numeric value by numeric values in the array.

Additionally, according to certain embodiments, the method further comprises combining a created array for a current chord with at least one created and stored array for an immediately previous chord, and determining a set of pitches for the current chord, based on the combined current and at least one immediately previous chord arrays.

BRIEF DESCRIPTION OF THE DRAWINGS

FIG. 2 shows an example of the creation of a chord array and determination of pitches using a single chord.

FIG. 3 shows an example of the creation of a combined array of multiple chord arrays and the determination of pitches using three chords.

DETAILED DESCRIPTION OF EXEMPLARY EMBODIMENTS

Figure 1:
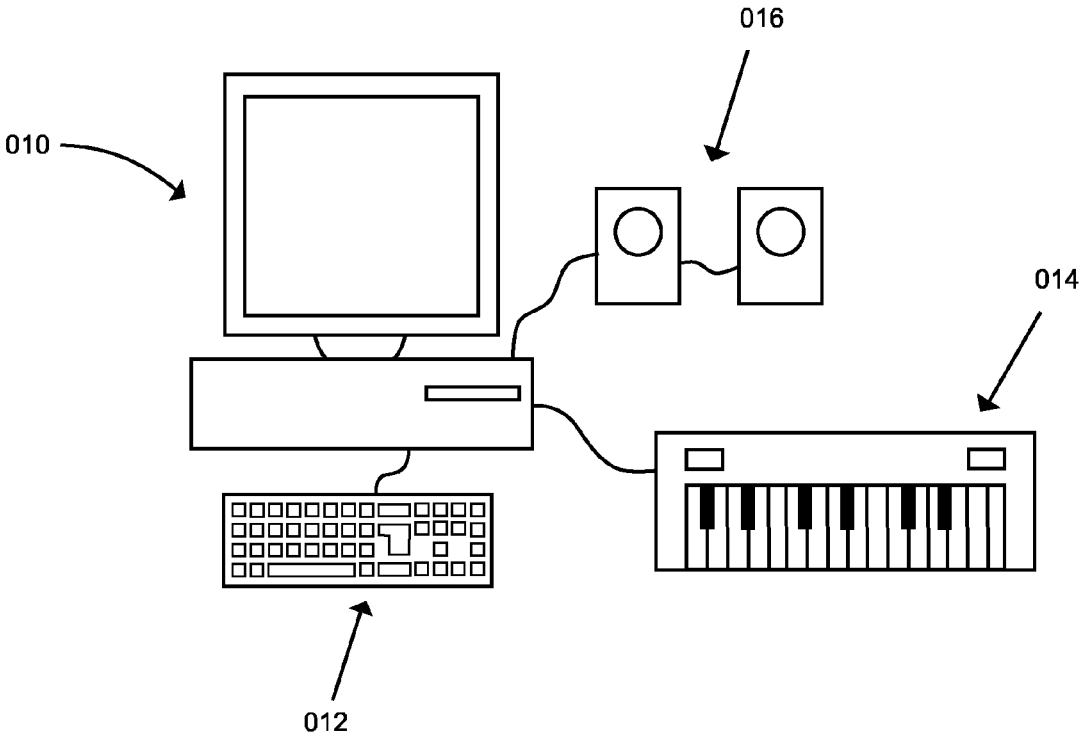
FIG. 1 shows an example of a system and electronic device according to embodiments of the present invention

FIG. 1 shows a system according to embodiments of the present invention. The system includes an electronic device 010 having a processor, several user inputs 012 and 014 and an audio output 016. The electronic device represented by FIG. 1 is in the form of a desktop computer. However, the electronic devices according to the present invention may be other than a desk top computer and may include tablet computers, smart phones, touch screen devices, mobile phones, etc. Additionally, the user inputs shown are a computer key board 012 and an electronic keyboard 014 for playing music. User inputs according to the present invention may also be other than those shown in FIG. 1, e.g. touch screen input, midi guitar, midi drum kit, electronic guitar, electronic violin, etc. Additionally, the electronic device comprises a computer readable medium. The computer readable medium can be transitory or non-transitory. According to certain embodiments of the present invention, the computer readable medium has stored thereon a set of computer implementable instructions for carrying out any of the methods described herein. Examples of audio outputs are speakers, such as 016 shown in FIG. 1, or merely an audio component capable of transmitting audio data to an internal or external emulation device or speaker, e.g. a head phone jack.

According to embodiments of the present invention there is a method of adjusting the complexity of a chord. Conventionally, an electronic musical user input, such as an electronic keyboard 014, has pre-programmed pitches associated with each key. These pre-programmed pitches correspond to the pitches from their acoustic counterparts. For example, someone familiar with paying an acoustic grand piano would be able to go to an electronic keyboard and immediately find the keys on the electronic keyboard which correspond to their counterparts on the acoustic grand piano and would be able to play a desired key by locating its position on the keyboard relative to the others.

A problem therefore exists that in order for someone to play an electronic keyboard as well as an acoustic piano they would need the same amount of training and practice as there is little if any difference between the playability of the two instruments. Therefore, in accordance with examples of the present invention it is possible to reduce the skill needed by a player to play an electronic keyboard while sounding, for example, as good as possible compared to a knowledgeable acoustic player. This is in part due to the knowledgeable acoustic player knowing the notes that should be played in a given chord, e.g. which notes sound good with each other.

Examples of how to assign notes to keys and electronic input devices can be found in U.S. application Ser. No.

13/739,023 titled 'Chord based method of assigning musical pitches to keys' filed Nov. 1, 2013 and incorporated by reference herein in its entirety.

However, players who would like to use current methods in reassigning the pitches of keys may want more or less freedom in the assignment of the pitches. Therefore, there is herein provided a method of adjusting the complexity of a chord which therein determines the actual set of pitches which can be assigned to a user input device.

According to certain embodiments, the method includes the step of receiving information about a chord. Information can be received via a user input device by a user. For example, a user may input that they would like to play in the 'C major' chord. Additionally, the indication that a 'C major' chord is to be played may come from audio data, video data, an audio source, and audio file, a video source, a video file, a text file or a combination thereof. For example, a user may be playing along to a particular song. The song may be an audio file. The audio file may have chord data associated therewith. There may also be chord detection software which is determining chord data with an associated file, e.g. audio file, being played. The chord data may be received therefore from any of these sources. Information about the chord can include the key of the chord, e.g. C, D, E, F, and the chord type, e.g. Major, minor, augmented or diminished.

Additionally, information about the desired chord complexity of the chord to be played is received. A user might, for example, have a user interface which allows the selection and/or input of chord complexity data. One example would be a sliding scale which the user can interact with between the simplest chord and the most complex chord. An example of the simplest chord would be the three main voices of a chord. An example of the most complex chord would be all of the notes of the chromatic scale. Another example of the most complex chord would be only the notes of the chord itself. The user may input the chord complexity data by other means such as, for example, entering a discrete number or selecting from a discrete number of choices of complexity. Furthermore, the input of chord complexity data could be automated, for example in a learning software the complexity of the chord could increase over a period of time or discrete time intervals.

Based on at least a portion of the received information about the chord, the method can create an array. The array can be created by adding the key of the chord to progression data for the chord type. Then, based on the created array and desired chord complexity, a set of pitches can be determined. The determined pitches then correlate to the key of the chord and the desired chord complexity.

As described herein, notes typically refer to the base notes in music, e.g. C, $C^{\#}$, D, $D^{\#}$, E, F, $F^{\#}$, G, $G^{\#}$, A, $A^{\#}$ & B. Similarly, one of ordinary skill in the art will recognize that these notes can be represented in alternative notation, e.g. $C^{\#}$ is the same as $D^{b}$. As described herein, pitches typically refer to discrete notes which can be played, e.g. the base note and the octave. However, pitches as described herein may be represented in their simplest form as the base note. Additionally, determining the pitches can be a one or two step process. One step being determining the base note and a second step determining the number and placement of octaves of each base note. The determining step herein may include either or both of these steps.

According to certain embodiments of the present invention, the determined set of pitches are then assigned to a user input device which allows a user to play the set of pitches. For example, the keys of an electronic keyboard 014 can be reassigned so that each corresponds only to one of the determined set of pitches. Another example would be that keys on an electronic keyboard 014 which do not correspond to one of the determined set of pitches, or base notes associated therewith, would be deactivated. E.g. such that when a player pressed a key corresponding to one of the determined pitches or corresponding base notes the electronic device would emulate a corresponding sound but if a player pressed a key corresponding to a pitch and/or base note not included in the determined pitches then the electronic device would not emulate a corresponding sound. Other examples include mapping the determined pitches to a plurality of positions on a touch screen input device.

According to certain examples of the present invention, there is a unique progression data set for each chord type (e.g. for each of Major chords, minor chords, augmented chords and diminished chords, and/or any other chord types if desired).

According to certain examples of the present invention, each key is represented by a unique numeric value. For example, the key being the representative key of a chord, i.e. for 'C major' the key is 'C' and the chord type is 'major'. For chords in the key of 'C', the key 'C' can be associated with the number 10. Key 'D' may be 14, key 'G' may be 18 and so on.

Each progression data set can be an array. The array can be of numeric values. The numeric values can correspond to note positions within a scale. An example of such is shown in FIG. 2. The first position in the array for a major chord type may be represented by the numeric value 1 and my correspond to the note C in a scale. The selection of values in the progression data sets, of the keys and of the chord complexity values can determine the overall 'quality' of the sound when heard by a listener when determined pitches are played.

Creating an array for a chord can include multiplying the key numeric value by numeric values in the array. An example is shown in FIG. 2 where the key numeric value of 10 for 'C' is multiplied through the major chord type progression data to create an array for the chord.

The desired chord complexity can also be represented by a numeric value. In the example of FIG. 2, the chord complexity received is represented by a value of 60. Determining the set of pitches can then include selecting notes in the created array having an associated value equal to or lesser than the numeric value of the desired chord complexity. In the example of FIG. 2, that includes notes C, D, E, G, A & B. These notes may also be pitches or they may be further used to determine a larger set of pitches including at least two octaves of at least one of those base notes.

As examples of the basic chord array creation and determination of notes and pitches are described above, one of ordinary skill will recognize equivalents to the decimal based numeric system which do not depart from the scope of the present invention, e.g. the use of binary or other base number numeric, alphanumeric, alphabetic or other symbolic systems. Additionally, while the examples have been shown wherein the pitches are determined by being equal to or lower than a number/symbol representing the chord complexity, other examples may include where the pitches are just lower, just higher or equal to or higher than a number/symbol representing the chord complexity.

It is further an aspect of certain embodiments of the present invention to build on the complexity of a current chord based on at least a portion of the history of chords played before. Often in music, even though a musician or composer is currently playing in one chord, their note and pitch choices are influenced by the chords which have come before. Therefore, created chord array's can be stored in a computer readable medium. They may be stored in a database for example. Additionally, combined arrays, as will be described below, can also be stored in a computer readable medium.

FIG. 3 shows an example of the combination of a current chord array with the previous two created and stored chord arrays. Such combinations can be between the current chord array and only the most previous stored chord array. Additionally, they may be combinations of more than one, such as two, three, four or more previously stored chord arrays.

The determined set of pitches for a current chord can then be based on the chord complexity data as well as the combined array, in place of merely just the current chord array.

FIG. 3 shows the 'C major' created chord from the example of FIG. 2 as the current created chord array. Additionally shown is a previous created and stored 'D minor' array and a G augmented array. Before combination there may be included weight factor with one or more of the arrays to be combined. This can be to account for the importance of previous chords in the determination of chord complexity increasing or decreasing over time. In the example of FIG. 3 the most previous created array is given a weight factor of 0.5. The second most recent created array is given a weight factor less than that of the most previous created array. The second weight factor in the example is 0.2. Additionally, the current chord array in the example is given a weight factor which is higher than all of the previous arrays. In the example it is 1. As the weight factor in the example is 1 it can also be considered to not have a weight factor at all.

The weight factors can be fixed, e.g. the most previous created chord array may always have a weight factor of 0.5. However, the weight factor may also be dynamic and change over time. For example, right after a chord change the weight factor of the most previous created chord array may be 0.8 and it might gradually or in a step wise manner decrease over time, e.g. over the first 10 seconds of the new chord, down to a fixed weight factor, e.g. of 0.5. The weight factor may also completely decrease over time down to 0 for one or more of the previous created chord arrays. Still yet, the chord combination may include the next upcoming chord, should that data be known. In such a case the upcoming chord may have a weight factor associated with it which starts at 0 and increases over time to 1 at the time when it becomes the current chord or even at a time slightly before it becomes the current chord, e.g. between 1 ms-1000 ms before. Combinations of the examples of weight factors described herein fall within the scope of the present invention.

Additionally, as shown in the example of FIG. 3, when creating the chord arrays, when multiplying the key by the progression data, the first representative note of the array can change. For example, the first position in the created chord array can correspond to the key of the chord followed by each of the next notes in the chromatic scale, see the created arrays for D minor and G augmented in FIG. 3. Prior to combination of multiple chord arrays, wherein values in the array correspond to discrete notes, e.g. C, $C^{\#}$, D, $D^{\#}$, E, etc. one or more of the arrays may be reordered in to a standard format, e.g. for C major or as shown in FIG. 2, or in to the format of the current chord. However, combining the created array for a current chord with at least one created and stored array for an immediately previous chord can include combining the values of similar notes to achieve a single combined array. An example, including the arrays being multiplied by their weight factor can be seen in the combined array in FIG. 3. For example, for note C, the value equals (10)*1+(140)*0.5+(126)*0.2=72. Similarly to the example of FIG. 2, the determined pitches can be those equal to or less than a complexity value, e.g. 110 in FIG. 3, which determines the pitches as being C D G and B.

Additionally, while chord information has been discussed herein in the form of key and chord type, other forms of chord information can be utilized. Information about a chord can come in the form of a plurality of notes, e.g. key independent, and/or pitches, notes with a corresponding key or keys. For example, a software or algorithm can be applied to an audio file which either determines a chord at a given time and/or a set of pitches during a given time. The information about a chord which is determined and/or the set of pitches which is determined can be used as chord information in the disclosed methods. Additionally, chord information, as discussed above, can be determined from a determined set of pitches.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A method of adjusting the complexity of a chord comprising the computer implemented steps of;

receiving information about a chord and desired chord complexity, creating an array by combining a key of the chord with progression data for a chord type of the chord, determining a set of pitches, which is a sub-set of pitches from the created array, based on the desired chord complexity, and assigning the set of pitches to a user input device which allows a user to play said set of pitches.

2. The method according to claim 1, wherein the information about a chord includes the key and chord type.

3. A method according to claim 1, wherein the chord type is selected from: major chord, minor chord, augmented chord and diminished chord.

4. A method according to claim 1, wherein there is a unique progression data set for each chord type.

5. A method according to claim 1, wherein each key is represented by a unique numeric value, each progression data set is an array of numeric values corresponding to note positions within a scale, and wherein creating an array for a chord includes multiplying the key numeric value by numeric values in the array.

6. A method according to claim 5, wherein the desired chord complexity is represented by a numeric value and the determined set of pitches correspond to notes having an associated value in the created and/or combined array equal to or lesser than the numeric value of the desired chord complexity.

7. A method according to claim 1, further comprising; storing the created array in a non-transitory computer readable medium.

8. A method according to claim 7, wherein the chord is in a set of chords and the method further comprising;

combining the created array for a current chord with at least one created and stored array for an immediately previous chord, and determining a sub-set of pitches from the combined array for the current chord, based on the combined current and at least one immediately previous chord arrays.

9. A method according to claim 8, wherein in each created array, values in the array correspond to discrete notes, e.g. C, C$^{\sharp}$, D, D$^{\sharp}$, E, etc., and combining the created array for a current chord with at least one created and stored array for an immediately previous chord includes combining the values of similar notes to achieve a single combined array.

10. A method according to claim 1, wherein information about a chord is in the form of a set of notes and/or pitches.

11. The method according to claim 1, wherein the set of pitches is assigned to a user input device which allows a user to play only said set of pitches while assigned.

12. A non-transitory computer readable medium having stored thereon a set of computer implementable instructions for carrying out the computer implemented steps of:

receiving information about a chord and desired chord complexity, creating an array by combining a key of the chord with progression data for a chord type of the chord, determining a set of pitches, which is a sub-set of pitches from the created array, based on the desired chord complexity and assigning the set of pitches to a user input device which allows a user to play said set of pitches.

13. The non-transitory computer readable medium of claim 12, further comprising:

combining the created array for a current chord with at least one created array for an immediately previous chord, and determining the set of pitches as a sub-set of pitches from the combined array based on the desired chord complexity.

14. The non-transitory computer readable medium of claim 12, wherein the set of pitches is assigned to a user input device which allows a user to play only said set of pitches while assigned.

15. The non-transitory computer readable medium of claim 12, wherein each key is represented by a unique numeric value, each progression data set is an array of numeric values corresponding to note positions within a scale, and wherein creating an array for a chord includes multiplying the key numeric value by numeric values in the array.

16. An electronic device comprising; a processor, a user input, an audio output and a non-transitory computer readable medium having stored thereon a set of computer implementable instructions for carrying out the computer implemented steps of:

receiving information about a chord and desired chord complexity, creating an array by combining the key of the chord to progression data for the chord type, determining a set of pitches, which is a sub-set of pitches from the created array, based on the desired chord complexity, and assigning the set of pitches to a user input device which allows a user to play said set of pitches.

17. The electronic device of claim 16, further comprising the computer implementable instructions of:

combining the created array for a current chord with at least one created array for an immediately previous chord, and determining the set of pitches as a sub-set of pitches from the combined array based on the desired chord complexity.

18. The electronic device of claim 16, wherein the set of pitches is assigned to the user input device which allows a user to play only said set of pitches while assigned.

19. The electronic device of claim 16, wherein each key is represented by a unique numeric value, each progression data set is an array of numeric values corresponding to note positions within a scale, and wherein creating an array for a chord includes multiplying the key numeric value by numeric values in the array.

* * * * *